US007002090B2

(12) United States Patent
Kato

(10) Patent No.: US 7,002,090 B2
(45) Date of Patent: Feb. 21, 2006

(54) KEY SWITCHES

(75) Inventor: Nobuo Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/986,935

(22) Filed: Nov. 15, 2004

(65) Prior Publication Data

US 2005/0167257 A1 Aug. 4, 2005

(30) Foreign Application Priority Data

Jan. 30, 2004 (JP) ..... 2004-023188

(51) Int. Cl.
*H01H 1/10* (2006.01)

(52) U.S. Cl. ..... 200/512; 200/341; 400/479

(58) Field of Classification Search ..... 200/314, 200/310, 512, 341, 517; 400/479, 491
See application file for complete search history.

(56) References Cited

U.S. PATENT DOCUMENTS

| | | | | |
|---|---|---|---|---|
| 4,654,488 A | | 3/1987 | Westfall | |
| 5,115,108 A | | 5/1992 | Ogawa et al. | |
| 5,401,927 A | * | 3/1995 | Lundell et al. | 200/314 |
| 5,980,135 A | * | 11/1999 | Shih-Hung | 400/479 |
| 6,580,043 B1 | * | 6/2003 | Spratte | 200/517 |
| 6,750,415 B1 | * | 6/2004 | Yamagami | 200/517 |

FOREIGN PATENT DOCUMENTS

| | | |
|---|---|---|
| EP | 0 841 672 A2 | 5/1998 |
| JP | A 7-235242 | 9/1995 |

* cited by examiner

*Primary Examiner*—Kyung Lee
(74) *Attorney, Agent, or Firm*—Oliff & Berrdige, PLC

(57) ABSTRACT

A key switch includes a front cover formed with a cursor key hole. In the front cover, a first rib is formed on a first support wall and a second rib is formed on a second support wall. Accordingly, when a cursor key part disposed in the cursor key hole is pressed, it can be restrained against motion in a shorter side direction. The operationality of a cursor key can be improved, which allows a correct operation.

25 Claims, 15 Drawing Sheets

KEY SWITCHES

BACKGROUND OF THE INVENTION

1. Field of the Invention

The present invention relates to a key switch to be used in an electronic apparatus such as a tape printer and particularly to a key switch adapted to restrain the motion of a key part in a direction of a shorter side thereof.

2. Description of Related Art

As one of key switches having a switch function using a contact, a key switch having a plurality of contacts which are selectively operated is disclosed for example in Japanese unexamined patent publication No. H7-235242 (1995-235242). In this switch device, an operating part is made of for example ABS resin by integral molding and a control knob is rotatable about a supporting point of the operating part and a contact part of a supporting point receiver of a guide part. When an operation display is pressed, the control knob is rotated about the supporting point and the contact part of the supporting point receiver, thereby pressing the top of one of a pair of tactile switches to turn the selected tactile switch ON. In this state, one of hinges formed for connecting the control knob with the operating part is bent and the other is extended. When released, the control knob is returned to an initial non-pressed position by a restoration force of the hinges, thus turning the tactile switch OFF.

However, for the use of a single switch, such as the switch device disclosed in the above publication '242, for two-way selection, the switch needs be formed to be elongated (in top view) in a selection direction, for example as shown in FIG. 17. In FIG. 17, a switch 100 tends to more largely move in a direction of a shorter side (a minor axis) as indicated by a double-headed arrow 102 as compared with in a direction of a longer side (a major axis), i.e. the selection direction, as indicated by arrows 101. This would lead to low operationality of the switch and disturb correct operation. When a width of a wall 103 extending radially outwardly from a lower periphery of the switch 100 is small in order to reduce the motion of the switch 100 in the minor axis direction, simultaneously, the switch 100 would also be restrained against motion in the major axis direction.

SUMMARY OF THE INVENTION

The present invention has been made in view of the above circumstances and has an object to overcome the above problems and to provide a key switch including a first rib in a pair of support walls facing each other to restrain the motion of a key part in a direction of a shorter side thereof, thereby improving operationality of the key part and allowing correct operation.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a key switch comprising: a cover provided with a key guide hole; an elongated key part having a side wall and being disposed in the key guide hole; a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed; wherein the key switch further comprises a first rib formed on each of the support walls, and the first rib comes into contact with the side wall when the key part is pressed so that the key part is restrained against motion in a shorter side direction.

In the above key switch, the first rib comes into contact with a side wall of the key part when pressed down, restraining the motion of the key part in a direction of the shorter side thereof. This makes it possible to prevent a rocking motion of the key part in the shorter side direction. Thus, the operationality of the key switch can be improved, which allows correct operation.

According to another aspect, the present invention provides a key switch comprising: a cover provided with a key guide hole; an elongated key part having a side wall and being disposed in the key guide hole; a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed; wherein the key switch further comprises a second rib formed on each of the support walls, and the second rib comes into contact with the supporting wall when the key part is pressed so that the key part is restrained against motion in a shorter side direction.

In the above key switch, the second rib comes into contact with the pair of support walls forming the key hole and facing in the shorter side direction of the key part when the key part is pressed down, so that the motion of the key part in the shorter side direction is restrained. This makes it possible to prevent rocking of the key part in the shorter side direction. Thus, the operationality of the key switch can be improved, which allows correct operation.

Further, according to another aspect, the present invention provides a key switch comprising: a cover provided with a key guide hole; an elongated key part having a side wall and being disposed in the key guide hole; a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed; wherein the key switch further comprises a first rib formed on each of the support walls and a second rib formed on each of the support walls, and the first rib comes into contact with the second rib when the key part is pressed so that the key part is restrained against motion in a shorter side direction.

In the key switch, the first rib comes into contact with the second rib when the key part is pressed down, thereby restraining the motion of the key part in the shorter side direction. This makes it possible to prevent rocking of the key part in the shorter side direction. Thus, the operationality of the key switch can be improved, which allows correct operation.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
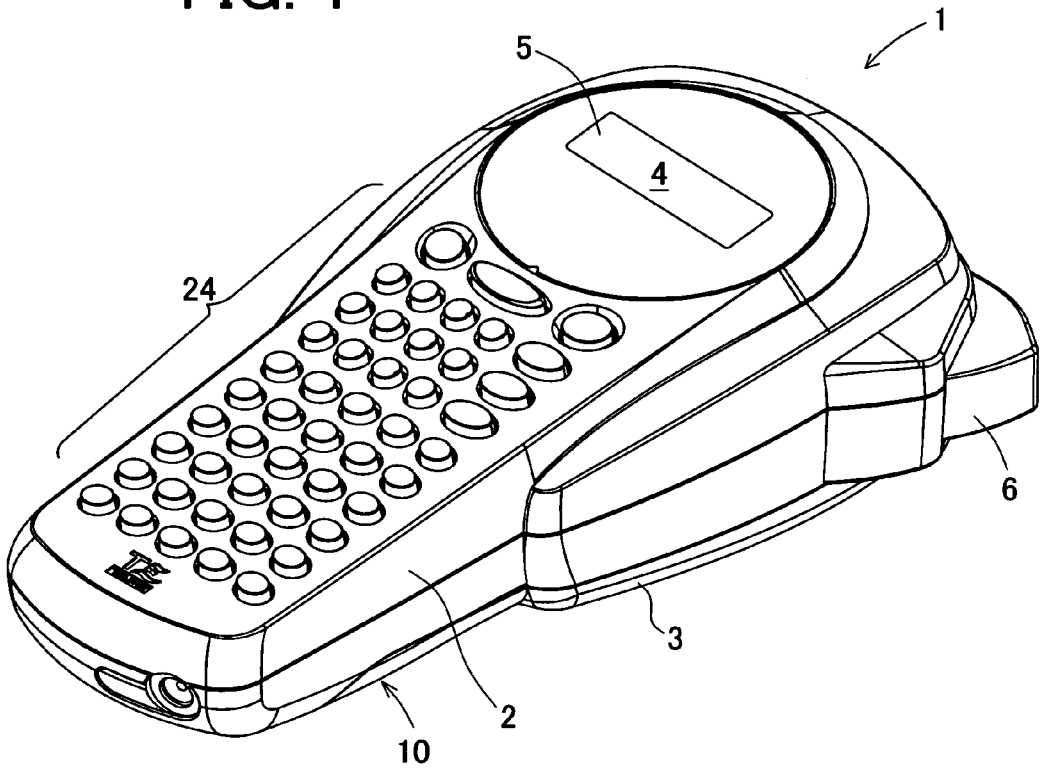
FIG. 1 is a schematic perspective view of a tape printer in a first embodiment.
Figure 2:
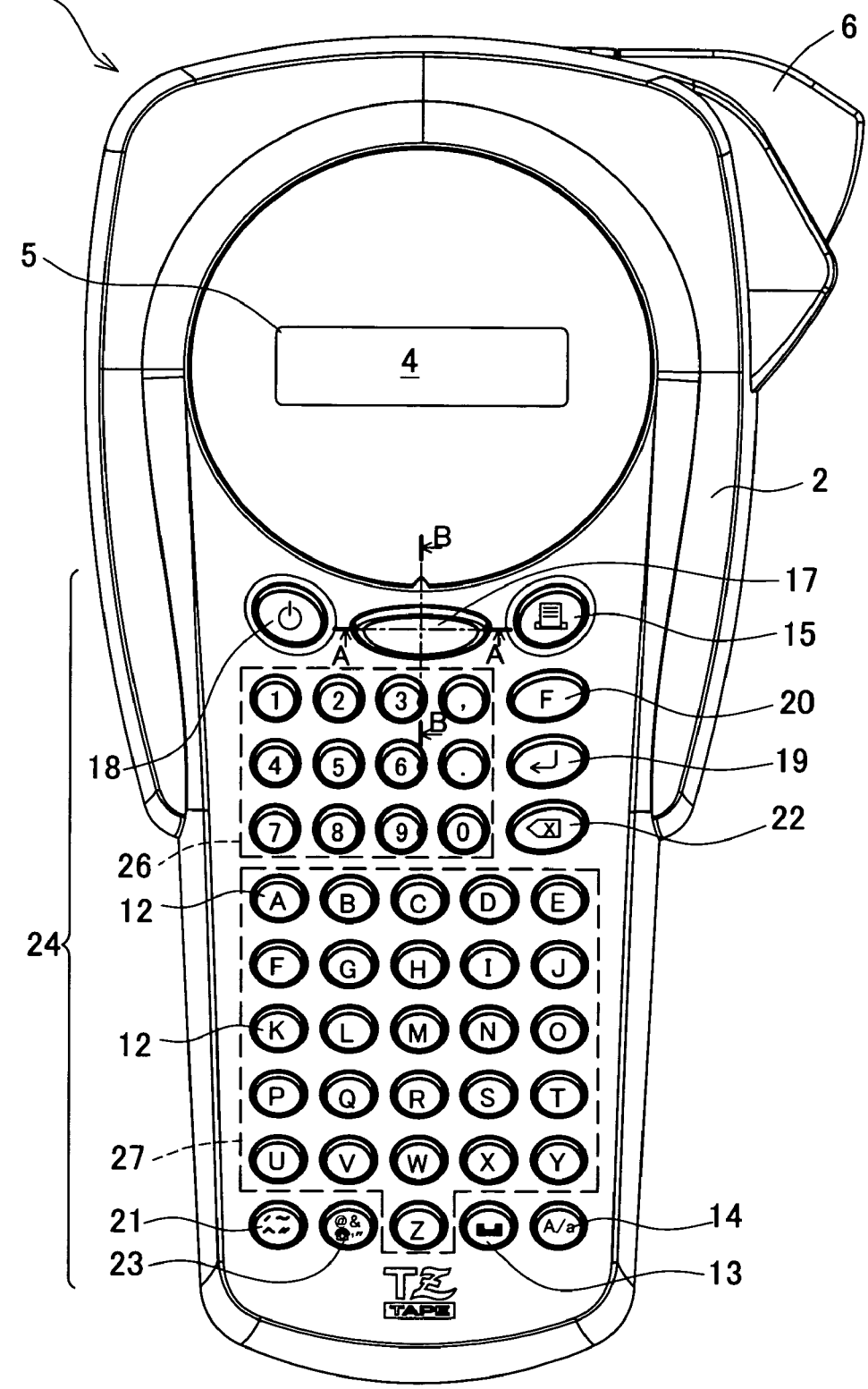
FIG. 2 is a front view of the tape printer of FIG. 1.
Figure 3:
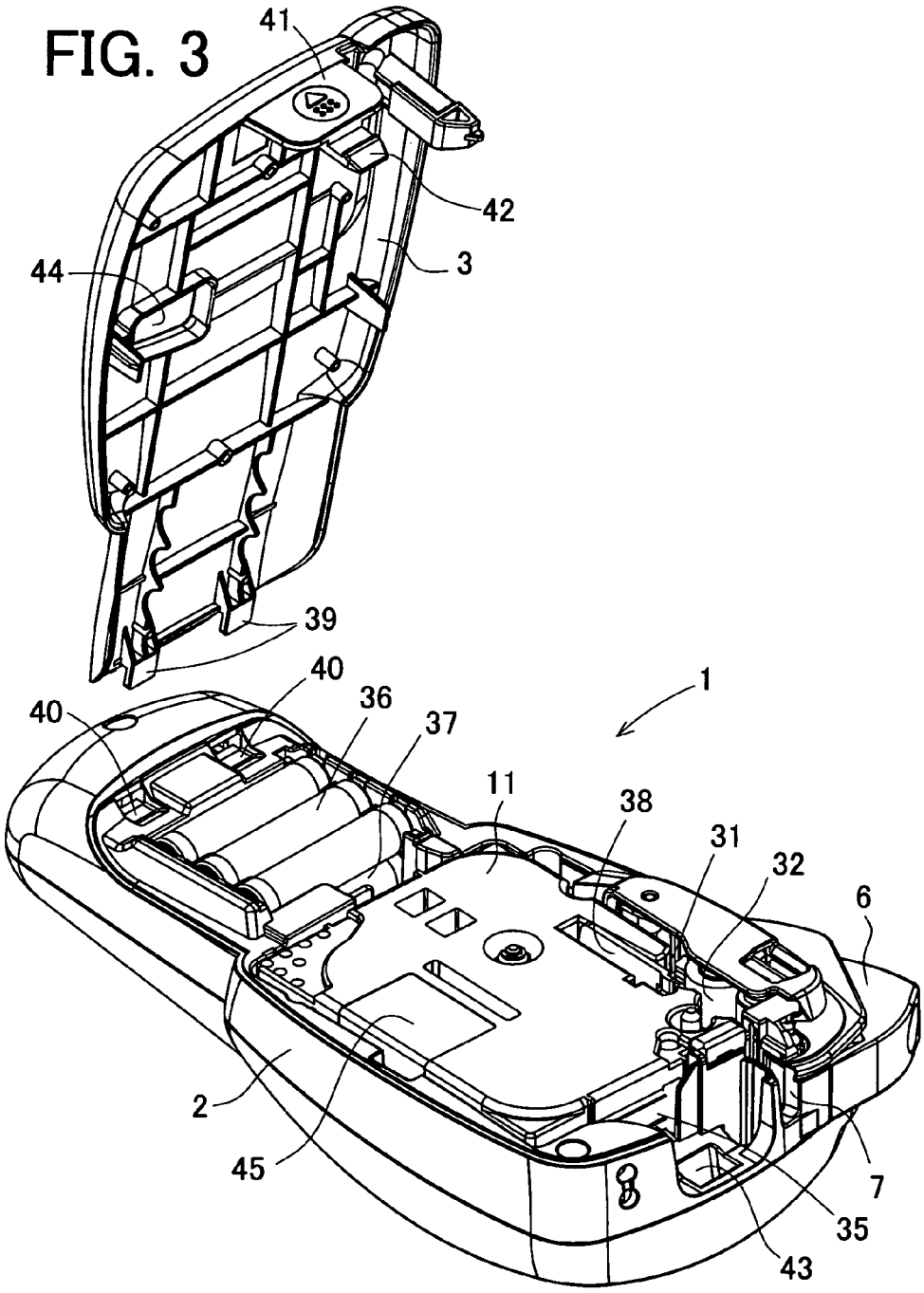
FIG. 3 is a perspective back view of the tape printer of FIG. 1, from which a back cover is removed and in which a tape cassette is set.

A detailed description of preferred embodiments of a key switch embodying the present invention will now be given referring to the accompanying drawings. A schematic structure of a tape printer including a key switch in a first embodiment is first explained with reference to FIGS. 1 to 3. FIG. 1 is a schematic perspective view of the tape printer in the first embodiment. FIG. 2 is a front view of the tape printer. FIG. 3 is a perspective back view of the tape printer from which a back cover is removed and in which a tape cassette is set.

As shown in FIGS. 1 and 2, the tape printer 1 includes a main body 2 made of synthetic resin and a back cover 3 made of synthetic resin. This back cover 3 is removably attached to the main body 2 to cover the entire back face of the main body 2, i.e., the opposite face to the front face of the tape printer 1 facing a user (operator) during use. The upper half part of the main body 2 in a longitudinal direction has a slightly rounded outer shape in plan view. The front face of the upper half part of the main body 2 is centrally formed with a rectangular window 4 which is horizontally long as shown in FIG. 2. In the window 4, a liquid crystal display (LCD) 5 is disposed. The main body 2 is further provided with a cutter lever 6 on the upper right side (at substantially an upper right corner in FIG. 2). When this cutter lever 6 is pressed inward by for example the thumb of a user, a printed tape discharged through a tape discharge port 7 (see FIG. 3) provided at the top of the tape printer 1 is cut out by a cutting blade (not shown).

The lower half part of the main body 2 in the longitudinal direction has a width slightly smaller than that of the upper half part and a right and left side faces having curved edges. This lower half part constitutes a holding part 10. The back cover 3 similarly has right and left side faces having curved edges to provide, in combination with the curved edges of the main body 2, a smoothly curved surface for the holding part 10. Further, the back cover 3 attached to the main body 2 is designed so that the tape printer 1 is gradually smaller in thickness from the upper half part internally holding a tape cassette 11 (see FIG. 3) to the lower half part, i.e., the holding part 10. Thus, the thickness of the holding part 10 is smaller than the thickness of the upper half part to allow a user to easily hold the tape printer 1 by hand.

In the holding part 10, on the front surface thereof, there is provided a keyboard 24 with a plurality of keys (see FIG. 4) integrally made of an elastic material, e.g., silicone rubber. Specifically, the keyboard 24 includes character keys 12 for producing a text including character data, a space key 13 for inputting a space, a Caps key 14 for shifting between upper and lower cases every time the key 14 is pressed, a print key 15 for issuing a command to print the text, a cursor key 17 for moving a cursor on the LCD 5 displaying characters such as letters and others, a power switch 18 for turning power ON/OFF, an enter key 19 for inputting a command to select character and others, a function key 20 for calling up a screen for selecting a function of changing a font and other functions, an accent key 21 for inputting an accent character used for input of German or French alphabets with accent marks, for example, [](umlaut), [ ](acute accent), etc., a back space key 22 for deleting one of the inputted characters displayed on the LCD 5, the one being immediately preceding a character on which a cursor is directly put, and a symbol key 23 for inputting a special symbol such as "@", "%", etc.

The character input keys 12 are mainly divided into a numeric key group 26 and an alphabet key group 27. The numeric key group 26 includes keys for inputting numerals "0" to "9", arranged closer to the LCD 5. The alphabet key group 27 includes keys for inputting alphabets "A" to "Z", arranged closer to the holding part 10. When the keys are pressed down, corresponding alphabets and numerals are inputted.

The main body 2 is provided, in the holding part 10, with a circuit board 29 (see FIG. 4) on which the keyboard 24 including the above mentioned keys is disposed. The main body 2 is further provided, between the holding part 10 and the LCD 5, a control board (not shown) on which a control circuit is formed. Further, a drive motor (not shown) for drivingly rotating a platen roller 32 (see FIG. 3) is placed in the main body 2, on the opposite side of the control board to a thermal head 31 and on the upper side in the longitudinal direction of the main body 2. This platen roller 32 serves as tape feeding means which feeds tape by means of a gear train not shown.

The main body 2 is further provided, in the area of the boards, the LCD 5, and the drive motor and others, with a cassette storage part 35 for storing the tape cassette 11 and a battery storage part 37 for storing a dry battery 36.

The cassette storage part 35 is formed to be substantially rectangular in plan view corresponding to the outer shape of the tape cassette 11 and to protrude backward (upward in FIG. 4) by a depth substantially equal to the thickness of the tape cassette 11. In the cassette storage part 35, on the bottom near the edge close to the cutter lever 6, a thermal head mounting part 38 formed of a thin plate is vertically provided at a right angle with the bottom and in a predetermined length along the longitudinal direction of the main body 2. The thermal head 31 is attached to the thermal head mounting part 38. The thermal head 31 is provided with a plurality of heating elements (not shown) arranged in line for printing characters and others on the printing tape through a printing ribbon (not shown).

The back cover 3 is attached to the main body 2 in the following manner. A pair of first insert parts (lugs) 39 formed at the edge of the back cover 3 on the holding part 10 side are first inserted in a pair of grooves 40 formed in the main body 2. Then, a hook 42 of a second insert part 41 provided on the opposite side to the first insert parts 39 is engaged in a recess 43 of the main body 2 to tightly attach the back cover 3 to the main body 2. To detach the back cover 3 from this state, on the other hand, a user has only to push the second insert part 41 inward, thereby disengaging the hook 42 from the recess 43. Thus, the back cover 3 can easily be detached from the main body 2. When the back cover 3 is detached, the tape cassette 11 can be taken out of the cassette storage part 35. Similarly, the dry batteries 36 in the battery storage part 37 can be taken out or replaced sequentially with new ones.

The back cover 3 is further provided with a window 44 for confirmation of the tape cassette 11. Through this window 44 of the back cover 3 attached to the main body 2, a user can see a cassette label 45 on which the kind of the tape cassette 11 is printed. Accordingly, the user can visually confirm the kind of the tape cassette 11 stored in the cassette storage part 35 without opening (detaching) the back cover 3.

Furthermore, on the bottom of the cassette storage part 35, a plurality of detection switches (seven switches in the present embodiment) are arranged. These detection switches are selectively turned on/off through a plurality (seven in combination in the present embodiment) of projections and depressions not shown provided on the bottom surface of the tape cassette 11. The tape cassette 11 may have the projections and depressions either singly or in combination. Based on a detection result thereon, the kind of the tape cassette can be detected.

The tape cassette 11 contains a printing tape and a printing ribbon. The kind of the tape cassette 11 used in the tape printer 1 in the present embodiment is identified by a combination of the printing tape and the printing ribbon contained therein. In the present embodiment, there are six usable tape widths; 6 mm, 9 mm, 12 mm, 18 mm, 24 mm, and 36 mm and two usable tape types; laminated tape and non-laminated tape.

An explanation will be given to an internal structure of the main body 2 of the tape printer 1 in the first embodiment, referring to FIG. 4 which is a perspective exploded view of the main body 2.

Figure 4:
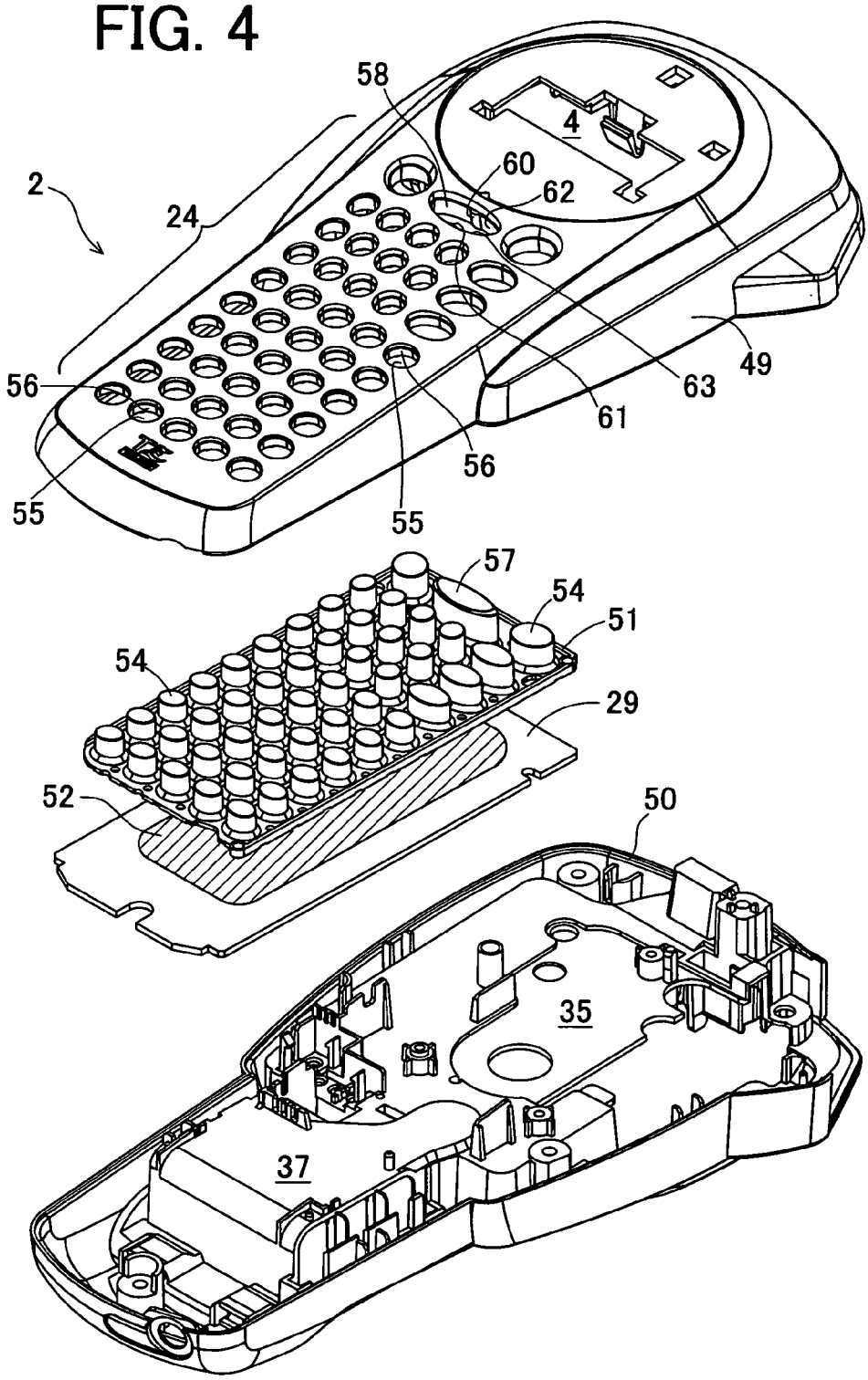
FIG. 4 is a perspective exploded view of a main body of the tape printer of FIG. 1.

As shown in FIG. 4, the main body 2 includes a front cover 49 and a main housing 50. The front cover 49 is formed with the window 4 and the keyboard 24. The main housing 50 is formed, on the rear side, with the cassette storage part 35 and the battery storage part 37. Between the front cover 49 and the main housing 50, there is mounted a rubber switch sheet 51 integrally made of an elastic material such as silicone rubber, providing the character key 12, space key 13, Caps key 14, print key 15, cursor key 17, power key 18, enter key 19, function key 20, accent key 21, back space key 22, and symbol key 23. Further, the circuit board 29 on which a circuit pattern 52 made of copper foil is printed is placed under the rubber switch sheet 51. This sheet 51 has a plurality of contacts which will be brought into contact with the circuit board 29 to provide a so-called rubber key structure which closes or opens the circuit pattern 52 through the contacts to turn each switch ON/OFF.

The rubber switch sheet 51 is formed with many key parts 54 each protruding in cylindrical shape to form a key. The upper cover 49 is formed with key holes 55 in which the key parts 54 are inserted to protrude outward. The number of the key holes 55 is equal to the number of key parts 54. Around each key hole 55, a cylindrical support wall 56 is formed to support (restrain) the motion of the corresponding key part 54 in a right/left, backward/forward directions when it is pressed down. The support wall 56 is also effective in preventing the pressed key part 54 from getting under the key hole 55.

Figure 5:
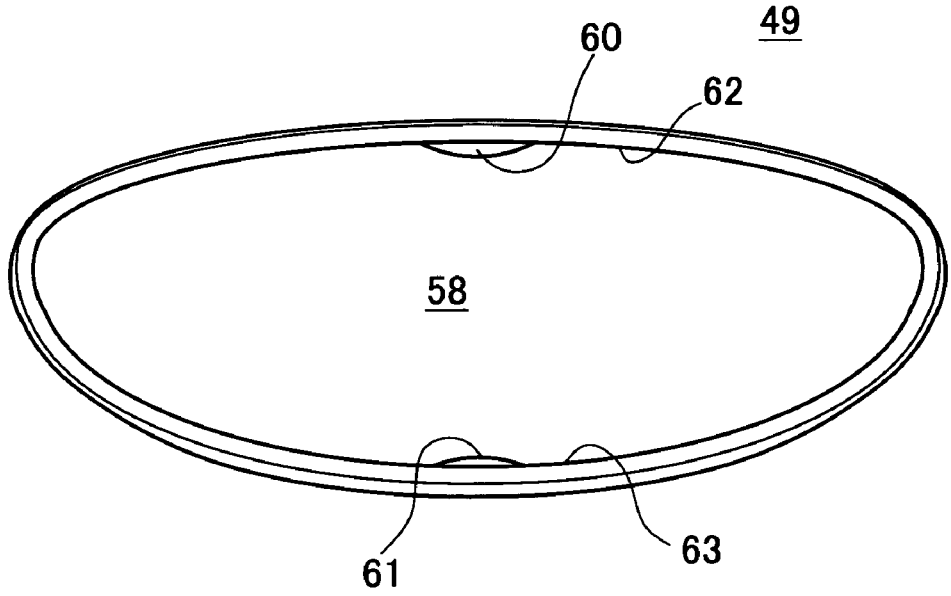
FIG. 5 is s front view of part of a front cover, in particular, a cursor key hole.

Among the key holes 55, a cursor key hole 58 for an elongated cursor key part 57 of the cursor key 17 includes a first support wall 62 and a second support wall 63 facing each other in the shorter side (minor axis) direction (i.e., in a vertical direction in FIG. 5). It is to be noted that the cursor key part 57 in the present embodiment is of an elliptic shape in top view, but may be another elongated shape. The first and second support walls 62 and 63 are provided with a first and second ribs 60 and 61 respectively protruding in face-to-face relation in the shorter side direction. FIG. 5 is a front view of the cursor key hole 58 in the front cover 49 in the first embodiment. The cursor key hole 58 corresponding to a key guide hole of the invention.

As shown in FIG. 5, the first and second ribs 60 and 62 are centrally formed in the first and second support walls 62 and 63 facing each other in the minor axis direction of the cursor key hole 58 to restrain motion of the cursor key part 57 inserted in the cursor key hole 58 in the minor axis direction (in the vertical direction in FIG. 5). The structure of restraining the motion of the cursor key part 57 and the operation and effects thereof will be mentioned later.

Figure 6:
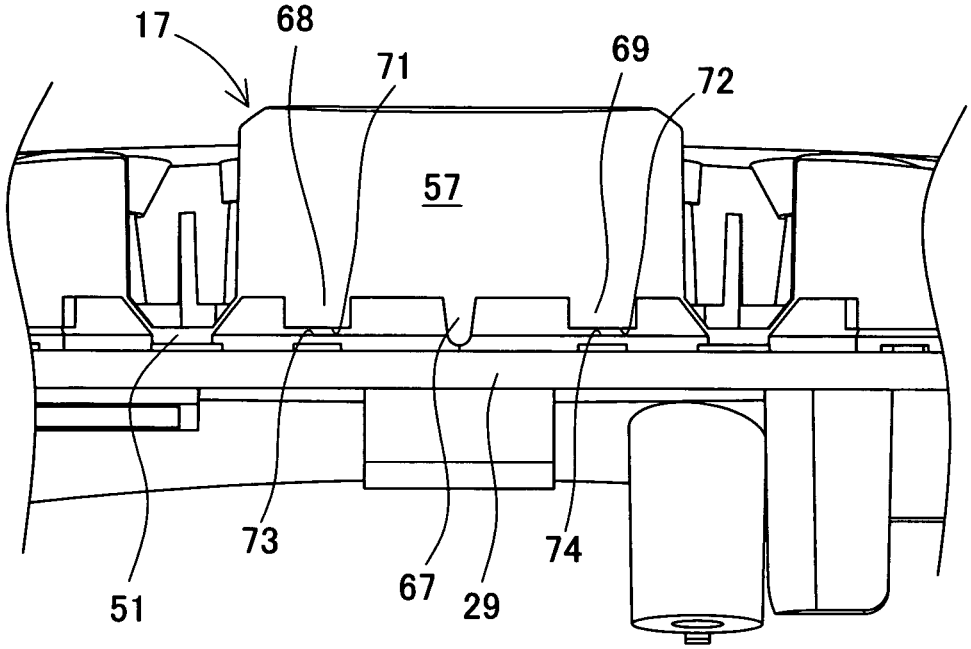
FIG. 6 is a sectional view of part of the tape printer taken along line A—A in FIG. 2, showing a cursor key switch and peripheral parts thereof.
Figure 7:
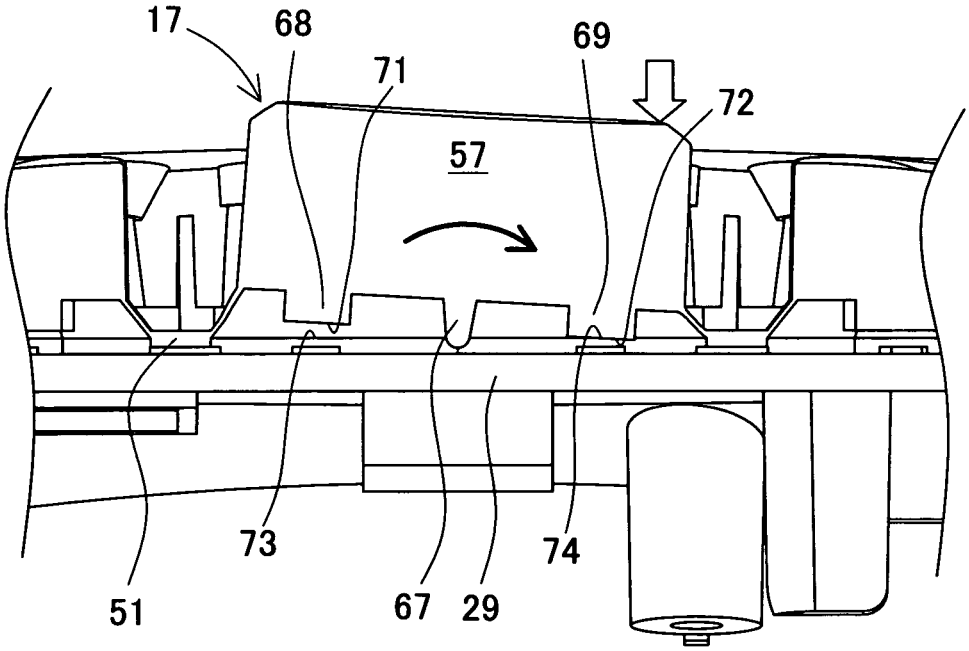
FIG. 7 is a sectional view of part of the tape printer taken along line A—A in FIG. 2, showing the cursor key switch and peripheral parts in a state where a cursor key part is pressed down.
Figure 8:
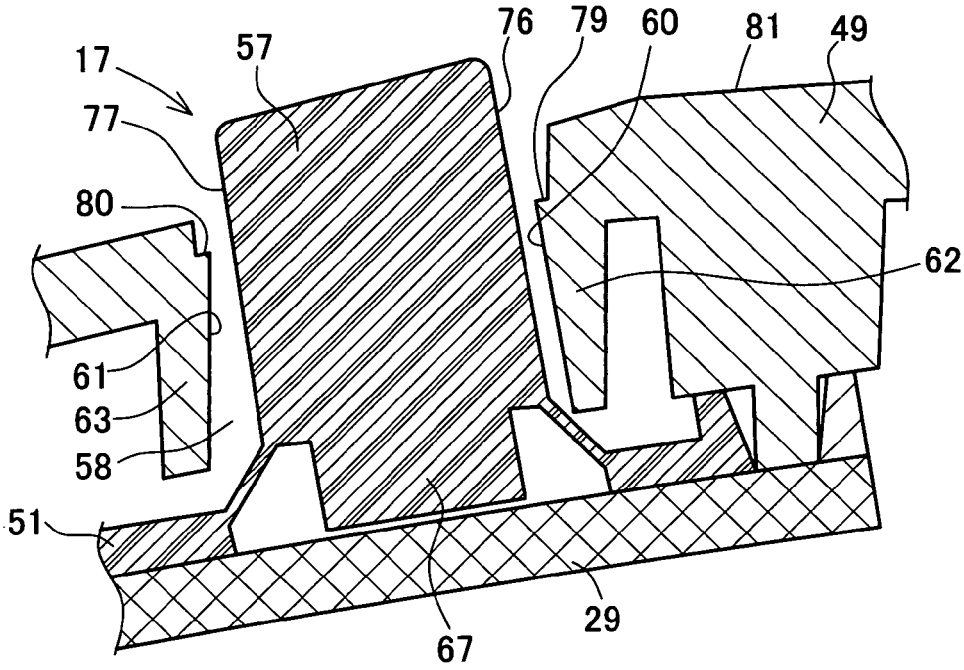
FIG. 8 is a sectional view of part of the tape printer taken along line B—B in FIG. 2, showing the cursor key switch and peripheral parts thereof.
Figure 9:
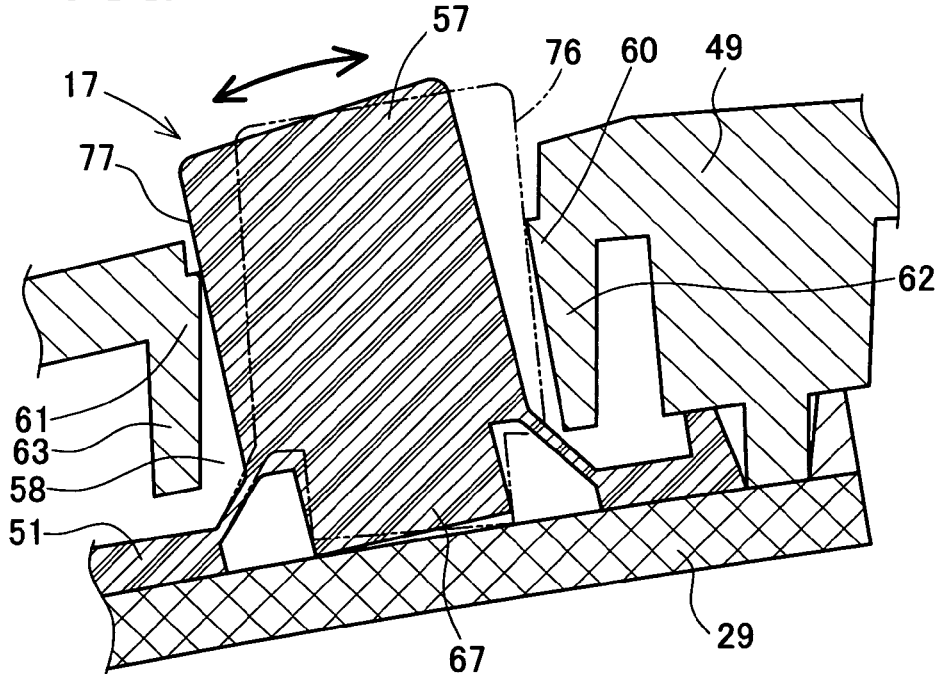
FIG. 9 is a sectional view of part of the tape printer taken along line B—B in FIG. 2, showing the cursor key switch and peripheral parts thereof in a state where a cursor key part is pressed down.

The cursor key 17, different from other keys, includes two contacts which will be brought into contact with the circuit board 29 so that a single key can selectively turn two contacts ON and OFF (see FIGS. 6 and 7). The structure of the cursor key 17 is explained below in detail with reference to FIGS. 6 through 9. FIG. 6 is a sectional view of part of the tape printer 1 taken along the line A—A in FIG. 2, showing the cursor key and its peripheral parts. FIG. 7 is a sectional view of part of the tape printer 1 taken along the line A—A in FIG. 2, showing the cursor key and its peripheral parts in a state where the cursor key part 57 is pressed down. FIG. 8 is a sectional view of part of the tape printer 1 taken along the line B—B in FIG. 2, showing the cursor key and its peripheral parts. FIG. 9 is a sectional view of part of the tape printer 1 taken along the line B—B in FIG. 2, showing the cursor key and its peripheral parts in a state where the cursor key part 57 is pressed down.

The cursor key 17 is an operating piece formed of a rubber key, which selectively activates two or more switch elements (two switch elements in the present embodiment) when the cursor key 17 is pressed down at different portions of the top surface of the cursor key part 57. When the cursor key 17 is pressed, an electrical conductive part provided in the cursor key part 57 is brought into contact with between terminals formed on the circuit pattern 52 printed on the circuit board 29, as shown in FIGS. 6 and 7, thereby the circuit is electrically connected or disconnected into an ON or OFF state.

The cursor key part 57 is provided, centrally on the bottom surface facing the circuit board 29, with a supporting wall 67 which extends downward and along the minor axis direction and serves as a supporting axis of turning motion of the cursor key part 57. The cursor key part 57 is further provided with a first and second pressing parts 68 and 69 on both sides of the supporting wall 67. These first and second pressing parts 68 and 69 are of a cylindrical shape and formed at respective ends (lower ends in FIG. 6) with a first and second switch contacts 71 and 72 respectively which will be brought into contact with the circuit board 29. These first and second switch contacts 71 and 72 contain conductive parts to electrically connect between terminals, e.g., a carbon part, not shown.

When a user presses an end of the cursor key part 57 of the cursor key 17 in the longer side direction (a major axis direction in FIG. 5) by his finger, the cursor key part 57 is turned about the supporting wall 67 in a pressing direction. Accordingly, the first switch contact 71 or the second switch contact 72 is moved down into contact with a first circuit contact 73 or a second circuit contact 74 formed on the circuit board 29, thereby turning the associated circuit contact 73 or 74 ON (see FIG. 7).

When the user releases his finger from the cursor key part 57, this cursor key part 57 is turned about the supporting wall 67 in a reverse direction to the above pressing direction by the elasticity of the rubber switch sheet 51. Thus, the first switch contact 71 or the second switch contact 72 is disconnected from the first circuit contact 73 or the second circuit contact 74 and is turned OFF (an initial state, see FIG. 6).

In the cursor key hole 58, as mentioned above, there are two ribs; the first rib 60 and the second rib 61 formed in the first support wall 62 and the second support wall 63 to protrude in face-to-face relation in the minor axis direction (see FIG. 5). The first and second ribs 60 and 61 are centrally arranged in the major axis direction of the cursor key part 57 inserted in the cursor key hole 58.

The first rib 60 is formed protruding from the first support wall 62 to be positioned face-to-face with a first side wall 76 of the cursor key part 57, as shown in FIG. 8, while the second rib 61 is formed protruding from the second support wall 63 to be positioned face-to-face with a second side wall 77 of the cursor key part 57.

The first and second ribs 60 and 61 are formed to extend along the vertical (height) direction of the supporting wall 67 in a state where the cursor key part 57 is set in the cursor key hole 58. This means that the ribs 60 and 61 are provided in a vertical direction perpendicular to the turning axis (the lower end of the supporting wall 67) about which the cursor key part 57 is turned when pressed.

When the one end of the cursor key 17 in the major axis is pressed, as mentioned above, the cursor key part 57 is turned rightward/leftward about the supporting wall 67 (see FIG. 7). At this time, pressing force is simultaneously exerted to no small extent on the cursor key part 57 in the minor axis direction (the vertical direction in FIG. 2). If such pressing force causes the cursor key part 57 to largely turn even in the minor axis direction, the desired switch contact 71 or 72 fails to precisely contact the corresponding circuit contact 73 or 74. This makes it impossible for a user to correctly operate the cursor key 17.

The first and second ribs 60 and 61 serve to restrain the motion of the cursor key part 57 in the minor axis direction while the cursor key part 57 is inserted in the cursor key hole 58.

When the cursor key part 57 is pressed and further moved toward the first support wall 62 (rightward in FIG. 9) by the pressing force, the first side wall 76 comes into contact with the first rib 60 of the first support wall 62. The cursor key part 57 is thus held against further motion toward the first support wall 62 (rightward in FIG. 9).

When the cursor key part 57 is moved toward the second support wall 63 (leftward in FIG. 9), the second side wall 77 comes into contact with the second rib 61 of the second support wall 63. The cursor key part 57 is held against further motion toward the second support wall 63 (leftward in FIG. 9).

As mentioned above, the first and second ribs 60 and 61 are used to restrain the motion of the cursor key part 57 in the minor axis direction (a vertical direction in FIG. 2). Since the first and second ribs 60 and 61 are centrally arranged in the major axis direction of the cursor key part 57 and extend along the vertical direction of the supporting wall 67, the friction between the cursor key part 57 and the first and second ribs 60 and 61 can be reduced to the minimum. It is therefore possible to restrain only the motion of the cursor key part 57 in the minor axis direction without preventing the motion in the major axis direction.

The cursor key part 57 made of an elastic material tends to largely move in the minor axis direction as well as in the major axis direction due to its own deformation when the cursor key 17 is pressed. However, the first and second ribs 60 and 61 can restrain the motion of the key part 57 in the major axis direction as mentioned above, so that the operationality of even an elastic key can be improved for correct key operation. Further, when such elastic key part 57 is pressed, it can mitigate the shock caused when the first and second ribs 60 and 61 come into contact with the first and second side walls 76 and 77. This makes it possible to perform smooth operation of the cursor key 17.

The first and second ribs 60 and 61 in the first embodiment are designed to have a first rib top 79 and a second rib top 80 respectively, which are positioned lower than the surface 81 of the front cover 49, as shown in FIG. 8. Thus, the ribs 60 and 61 are made invisible from outside, resulting in an improved appearance of the tape printer 1.

Figure 10:
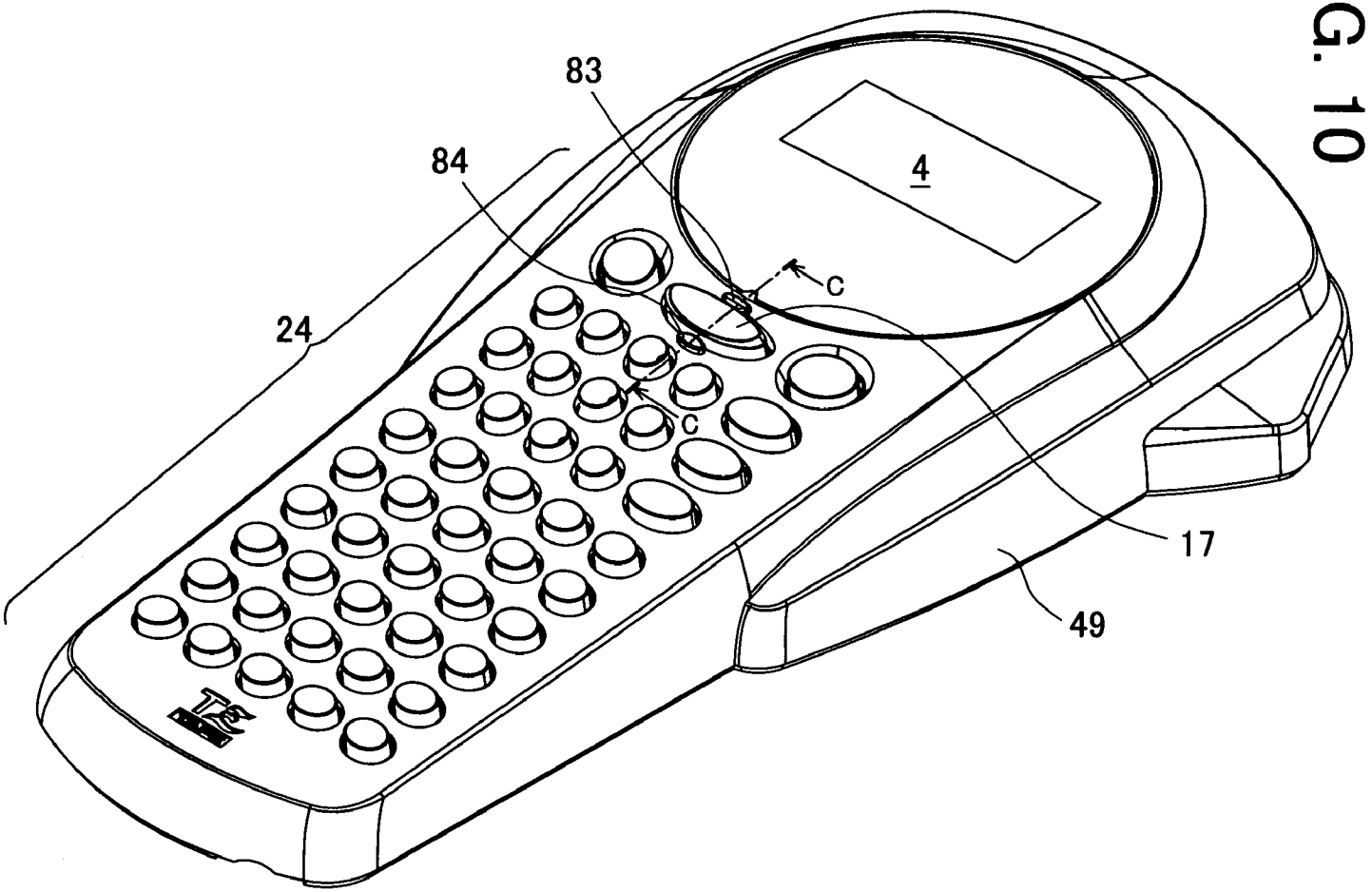
FIG. 10 is perspective view of a tape printer with a front cover different from that in the first embodiment, the front cover including a first and second ribs having a larger height.
Figure 11:
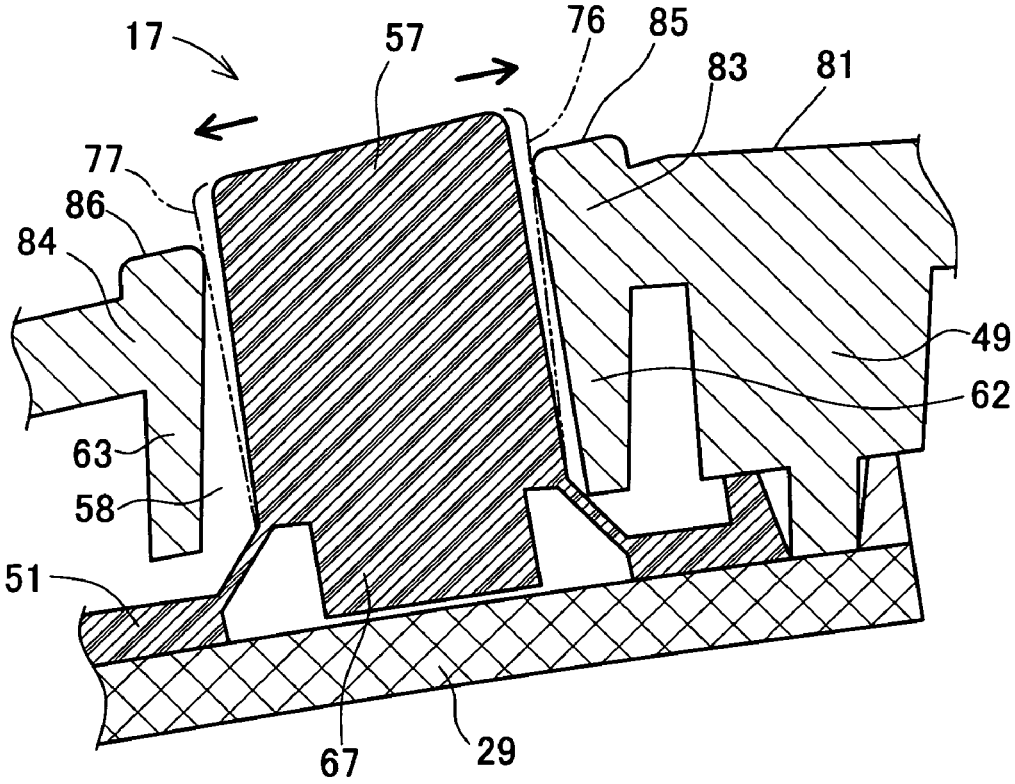
FIG. 11 is a sectional view of part of the tape printer taken along line C—C in FIG. 10.

Alternatively, the first and second ribs 60 and 61 may be designed to be longer. Such ribs can restrain more effectively the motion of the cursor key part 57 in the minor axis direction. FIG. 10 is a perspective view of a modification of the front cover 49 including a first and second ribs formed to be longer with respective rib tops positioned higher than the tops 79 and 80 of the first and second ribs 60 and 61. FIG. 11 is a sectional view of part of the tape printer, in particular, the front cover 49, taken along the line C—C in FIG. 10.

As shown in FIG. 11, a first rib 83 and a second rib 84 of the upper cover 49 in this modification protrude from the surface 81 to have a first rib top 85 and a second rib top 86 respectively positioned higher than the surface 81. When the cursor key part 57 is moved toward the first support wall 62 (rightward in FIG. 11) by the pressing force, the first side wall 76 comes into contact, at a higher point, with the first rib 83 of the first support wall 62 (see FIG. 11). Accordingly, the cursor key part 57 is deformed into contact with the first rib 83 in a smaller deformation amount than in the first embodiment. When the cursor key part 57 is moved toward the second support wall 63 (leftward in FIG. 11), similarly, the second side wall 77 comes into contact, at a higher point, with the second rib 84. Thus, the cursor key part 57 is deformed into contact with the second side wall 77 in a smaller deformation amount.

Consequently, the first and second ribs 83 and 84 can more surely restrain the motion of the cursor key part 57 in the minor axis direction (rightward/leftward in FIG. 11).

In the tape printer 1 having the switch structure in the first embodiment, as explained above, the front cover 49 formed with the cursor key hole 58 is provided with the first and second ribs 60 and 61 in the first and second support walls 62 and 63 respectively. This structure makes it possible to restrain the motion of the key part 57 in the minor axis direction (rightward/leftward in FIG. 2). Accordingly, the cursor key 17 can be prevented from rocking in the minor axis direction while a user operates the cursor key 17. It is therefore possible to improve the operationality of the cursor key 17 and to allow a user to correctly operate it.

Figure 12:
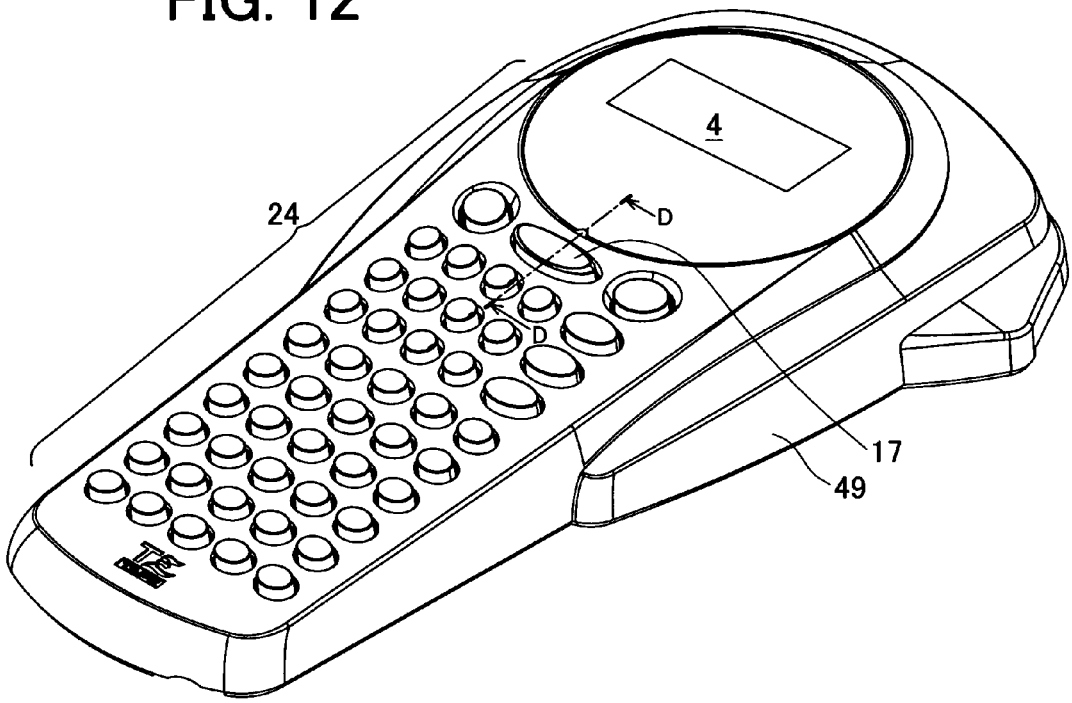
FIG. 12 is a perspective view of a front cover of a tape printer in a second embodiment.
Figure 13:
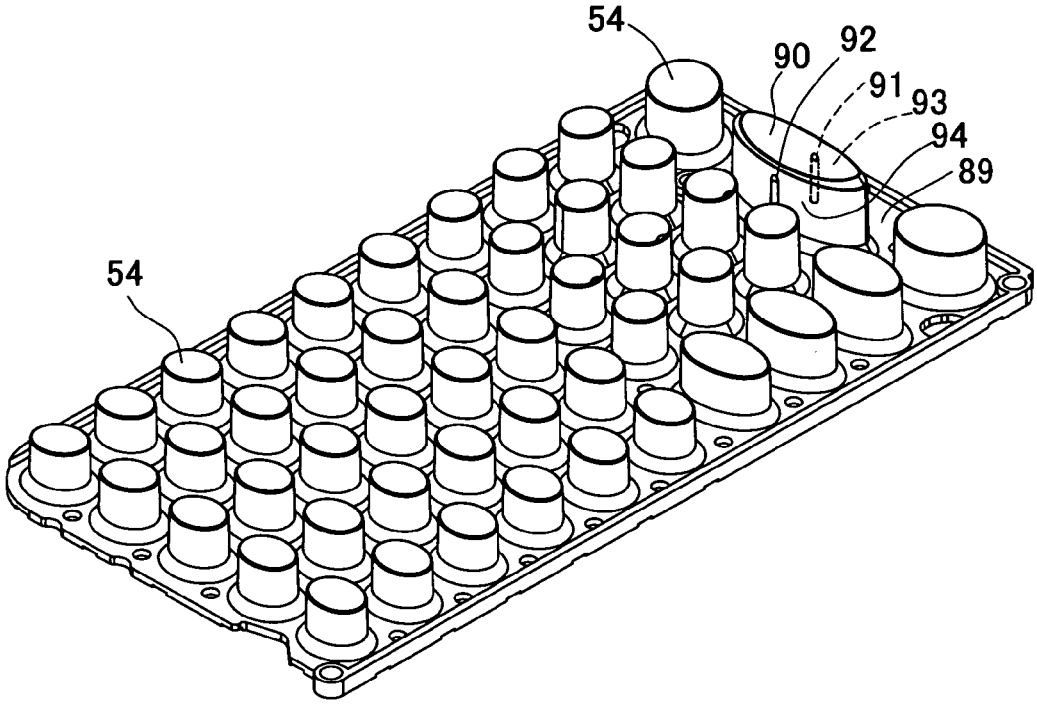
FIG. 13 is a perspective view of a rubber switch sheet of the tape printer in the second embodiment.
Figure 14:
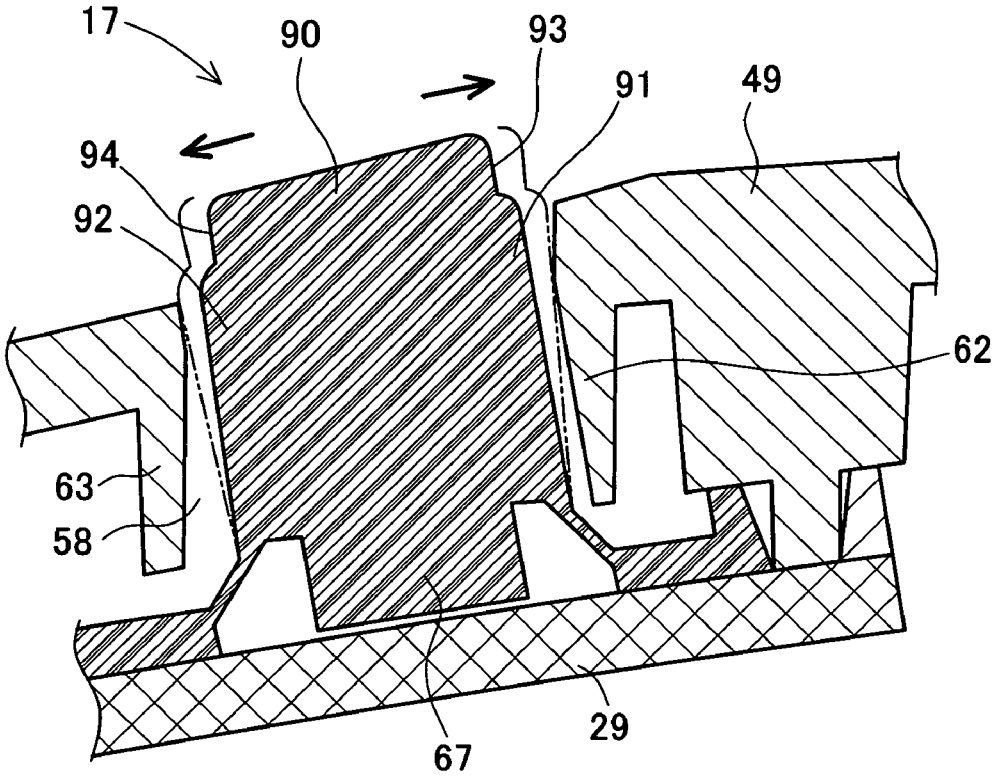
FIG. 14 is a sectional view of part of the tape printer taken along line D—D in FIG. 12.

An explanation will be given below to a tape printer having a switch structure in a second embodiment, referring to FIGS. 12 through 14. FIG. 12 is a perspective view of a front cover of a tape printer in the second embodiment. FIG. 13 is a perspective view of a rubber switch sheet of the tape printer in the second embodiment. FIG. 14 is a sectional view of part of the front cover taken along the line D—D in FIG. 12.

The tape printer in the second embodiment is basically identical in structure to that in the first embodiment except for only the following structure. The tape printer 1 in the first embodiment includes two ribs (the first and second ribs 60 and 61) formed in a pair of support walls (the first and second support walls 62 and 63) facing each other in the cursor key hole 58. Instead of this structure, the tape printer in the second embodiment is provided with ribs as part of the cursor key part, not the cursor key hole.

The following explanation is therefore made with a focus on the specific structure in the second embodiment. Identical parts or components to those in the first embodiment are indicated by the same numerals.

In the tape printer in the second embodiment, the cursor key 17 includes a cursor key part 90 that is formed on a rubber switch sheet 89 and formed with two ribs: a third and fourth ribs 91 and 92 protruding outward in diametrical opposed positions. Specifically, the third rib 91 is provided on a first side wall 93 which faces the first support wall 62 when the key part 90 is inserted in the cursor key hole 58. The fourth rib 92 is provided on a second side wall 94 which faces the second support wall 62 when the key part 90 is inserted in the cursor key hole 58. Further, the third and fourth ribs 91 and 92 are formed in a direction parallel to the height (vertical) direction of the supporting wall 67 extending downward from the undersurface of the cursor key part 90, along the minor axis thereof, and centrally in the major axis. The third and fourth ribs 91 and 92 are also arranged on the line passing the center of the major axis of the cursor key part 90, that is, in opposed positions of the minor axis.

The third and fourth ribs 91 and 92 serve to restrain the motion of the cursor key part 90 in the minor axis direction as with the first and second ribs 60 and 61 in the first embodiment.

When the cursor key part 90 is moved by a user's finger and moved toward the first support wall 62 (rightward in FIG. 14) under action of the pressing force, the third rib 91 comes into contact with the first support wall 62. At this time, the third rib 91 restrains the further motion of the key part 90 toward the first support wall 62 (rightward in FIG. 14).

When the cursor key part 90 is moved toward the second support wall 63 (leftward in FIG. 14), similarly, the fourth rib 92 comes into contact with the second support wall 63, thereby restraining the further motion of the key part 90 toward the second support wall 63 (leftward in FIG. 14).

As above, the ribs 91 and 92 serve to restrain the motion of the cursor key part 90 in the minor axis direction (rightward/leftward in FIG. 14). Since the third and fourth ribs 91 and 92 are provided to extend along to the vertical (or height) direction of the supporting wall 67 extending downward from the center of the undersurface of the cursor key part 90, the friction between the first support wall 62 and the third rib 91 and between the second support wall 63 and the fourth rib 92 can be reduced to the minimum. It is therefore possible to restrain only the motion of the cursor key part 90 in the minor axis direction without preventing the motion in the major axis direction.

The cursor key part 90 made of an elastic material tends to largely move in the minor axis direction due to its own deformation when the cursor key 17 is pressed. However, the third and fourth ribs 91 and 92 can restrain the motion of the key part 90 in the minor axis direction as mentioned above, so that the operationality of even an elastic key can be improved for correct key operation. Further, when the elastic key part 90 is pressed, it can mitigate the shock caused when the third and fourth ribs 91 and 92 come into contact with the first and second support walls 62 and 63. This makes it possible to perform smooth operation of the cursor key 17.

In the tape printer having the switch structure in the second embodiment, as explained above, the cursor key part 90 is formed with the third and fourth ribs 91 and 92 on the first and second side walls 93 and 94 respectively. This structure makes it possible to restrain the motion of the key part 90 in the minor axis direction (rightward/leftward in FIG. 14). Accordingly, the cursor key 17 can be prevented from rocking in the minor axis direction while a user operates the cursor key 17. It is therefore possible to improve the operationality of the cursor key 17 and to allow a user to correctly operate it.

Figure 15:
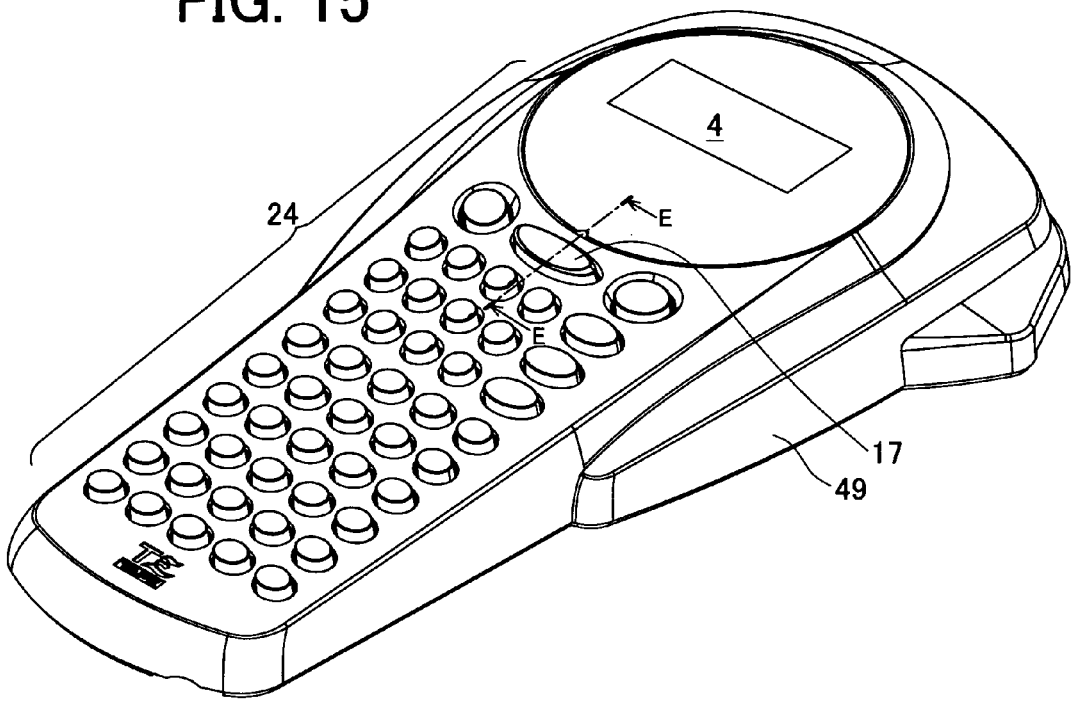
FIG. 15 is a perspective view of a front cover of a tape printer in a third embodiment.
Figure 16:
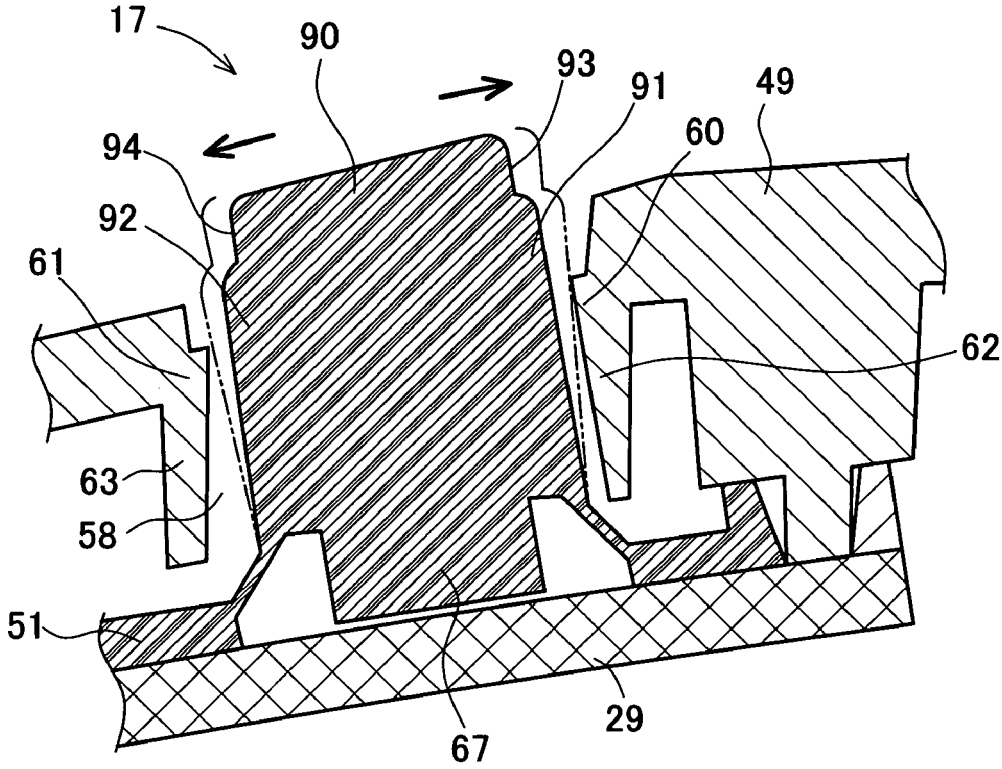
FIG. 16 is a sectional view of part of the tape printer taken along line E—E in FIG. 15.
Figure 17:
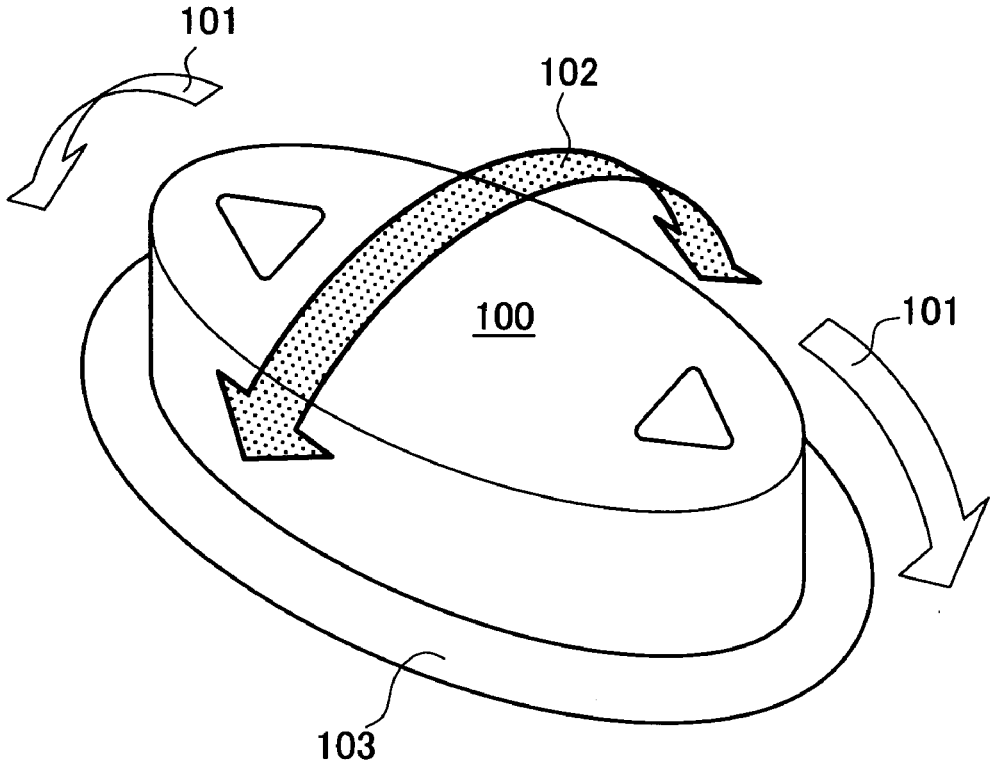
FIG. 17 PRIOR ART
FIG. 17 is a perspective view of a switch structure in a prior art.

An explanation will be given below to a tape printer having a switch structure in a third embodiment, referring to FIGS. 15 and 16. FIG. 15 is a perspective view of a front cover of a tape printer in the third embodiment. FIG. 16 is a sectional view of part of the tape printer taken along the line E—E in FIG. 15.

The tape printer in the third embodiment is basically identical in structure to that in the second embodiment except for only the following structure. Specifically, the tape printer in the second embodiment includes two ribs (the third and fourth ribs 91 and 92) formed in the first and second side walls 93 and 94 of the cursor key part 90 respectively. On the other hand, the tape printer in the third embodiment is further provided with, in addition to the third and fourth ribs 91 and 92, two ribs (a first and second ribs 60 and 61) formed on a pair of first and second support walls facing each other in the minor axis direction of the cursor key hole 58.

The following explanation is therefore made with a focus on the specific structure in the third embodiment. Identical parts or components to those in the second embodiment are indicated by the same numerals.

In the tape printer in the third embodiment, the first and second ribs 60 and 61 are formed on a pair of first and second support walls 62 and 63 to protrude in face-to-face relation in the cursor key hole 58. Further, the third rib 91 and the fourth rib 92 are formed on the first side wall 93 and the second side wall 94 to protrude in opposed positions of the minor axis. These first, second, third, and fourth ribs 60, 61, 91, and 92 are provided to extend in a direction parallel to the vertical, or height, direction of the supporting wall 67 extending downward from the undersurface of the cursor key part 90 in the center of the major axis.

As with the first and second ribs 60 and 61 in the first embodiment and the third and fourth ribs 91 and 92 in the second embodiment, the first to fourth ribs 60, 61, 91, and 92 in the third embodiment serve to restrain the motion of the cursor key part 90 in the minor axis direction.

When the cursor key part 90 provided with the third and fourth ribs 91 and 92 as shown in FIG. 16 is pressed by a user's finger and moved toward the first support wall 62 (rightward in FIG. 16) under action of the pressing force, the third rib 91 comes into contact with the first rib 60. At this time, the third rib 90 restrains the further motion of the cursor key part 90 toward the first support wall 62 (rightward in FIG. 16).

When the cursor key part 90 is moved toward the second support wall 63 (leftward in FIG. 16), similarly, the fourth rib 92 comes into contact with the second rib 61, thereby restraining the further motion of the key part 90 toward the second support wall 63 (leftward in FIG. 16).

As above, the ribs 91 and 92 serve to restrain the motion of the cursor key part 90 in the minor axis direction (rightward/leftward in FIG. 16). Since the first, second, third, and fourth ribs 60, 61, 91, and 92 are provided to extend in the vertical, or height, direction of the supporting wall 67 extending downward from the center of the under surface of the cursor key part 90, the friction between the ribs can be reduced to the minimum. It is also possible to restrain only the motion of the cursor key part 90 in the minor axis direction without preventing the motion in the major axis direction.

The cursor key part 90 made of an elastic material tends to largely move in the minor axis direction as well as in the major axis direction due to its own deformation when the cursor key 17 is pressed. However, the first, second, third, and fourth ribs 60, 61, 91, and 92 can restrain the motion of the key part 90 in the minor axis direction, so that the operationality of even an elastic key can be improved for correct key operation. Further, when the elastic key part 90 is pressed, it can mitigate the shock caused when the first and second ribs 60 and 61 come into contact with the third and fourth ribs 91 and 92 in association with depression of the key part 90. This makes it possible to perform smooth operation of the cursor key 17.

In the tape printer having the switch structure in the third embodiment, as explained above, the first and second ribs 60 and 61 are formed on the first and second support walls 62 and 63 respectively and the third and fourth ribs 91 and 92 are formed on the first and second side walls 93 and 94 of the cursor key part 90 respectively. This structure makes it possible to restrain the motion of the key part 90 in the minor axis direction (rightward/leftward in FIG. 16). Accordingly, the cursor key 17 can be prevented from rocking in the minor axis direction while a user operates the cursor key 17. It is therefore possible to improve the operationality of the cursor key 17 and to allow a user to correctly operate it.

The present invention may be embodied in other specific forms without departing from the essential characteristics thereof. For instance, in the first, second, and third embodiments, the first, second, third, and fourth ribs 60, 61, 91, and 92 are disposed one on the line passing the center of the major axis of the cursor key part 90. In an alternative, two or more ribs may be provided near the line passing the center of the major axis of the cursor key part 90.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A key switch comprising:

a cover provided with a key guide hole;

an elongated key part having a side wall and being disposed in the key guide hole;

a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed;

wherein the key switch further comprises a first rib formed on each of the support walls, and the first rib comes into contact with the side wall when the key part is pressed so that the key part is restrained against motion in a shorter side direction.

2. The key switch according to claim 1, wherein the key part includes a supporting wall extending downward from an undersurface of the key part at substantially a center in the longer side direction and along the shorter side direction, the first rib is provided extending in a direction along the supporting wall.

3. The key switch according to claim 1, wherein the first rib is positioned face-to-face with a center of the side wall of the key part in the longer side direction.

4. The key switch according to claim 1, wherein the first rib includes a top, and the first rib is formed protruding from a surface of the cover so that the top is positioned above the surface of the cover.

5. The key switch according to claim 4, wherein the key part includes a supporting wall extending downward from an undersurface of the key part at substantially a center in the longer side direction and along the shorter side direction, the first rib is provided extending in a direction along the supporting wall.

6. The key switch according to claim 5, wherein the first rib is positioned face-to-face with a center of the side wall of the key part in the longer side direction.

7. The key switch according to claim 6, wherein the key part is made of an elastic material.

8. The key switch according to claim 4, wherein the first rib is positioned face-to-face with a center of the side wall of the key part in the longer side direction.

9. The key switch according to claim 1, wherein the key part is made of an elastic material.

10. A key switch comprising:

a cover provided with a key guide hole;

an elongated key part having a side wall and being disposed in the key guide hole;

a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed;

wherein the key switch further comprises a second rib formed on each of the support walls, and the second rib comes into contact with the side wall when the key part is pressed so that the key part is restrained against motion in a shorter side direction.

11. The key switch according to claim 10, wherein the key part includes a supporting wall extending downward from an undersurface of the key part at substantially a center in the longer side direction and along the shorter side direction, the second rib is provided extending in a direction along the supporting wall.

12. The key switch according to claim 11, wherein the second rib is positioned face-to-face with a center of the side wall of the key part in the longer side direction.

13. The key switch according to claim 12, wherein the key part is made of an elastic material.

14. The key switch according to claim 10, wherein the second rib is positioned face-to-face with a center of the side wall of the key part in the longer side direction.

15. The key switch according to claim 10, wherein the key part is made of an elastic material.

16. A key switch comprising:

a cover provided with a key guide hole;

an elongated key part having a side wall and being disposed in the key guide hole;

a pair of support walls provided in the key guide hole so that the support walls face each other in a shorter side direction of the key part; and a circuit board including a first contact and a second contact and being disposed below the key part, the first contact being turned on when one end portion of the key part in a longer side direction is pressed and the second contact being turned on when the other end portion of the key part is pressed;

wherein the key switch further comprises a first rib formed on each of the support walls and a second rib formed on each of the support walls, and the first rib comes into contact with the second rib when the key part is pressed so that the key part is restrained against motion in a shorter side direction.

17. The key switch according to claim 16, wherein the key part includes a supporting wall extending downward from an undersurface of the key part at substantially a center in the longer side direction and along the shorter side direction, the first rib is provided extending in a direction along the supporting wall.

18. The key switch according to claim 17, wherein the first rib is positioned face-to-face with a center of the side wall of the key part in the longer side direction.

19. The key switch according to claim 18, wherein the key part is made of an elastic material.

20. The key switch according to claim 16, wherein the first rib is positioned face-to-face with a center of the side wall of the key part in the longer side direction.

21. The key switch according to claim 16, wherein the key part includes a supporting wall extending downward from an undersurface of the key part at substantially a center in the longer side direction and along the shorter side direction, the second rib is provided extending in a direction along the supporting wall.

22. The key switch according to claim 21, wherein the second rib is positioned face-to-face with a center of the side wall of the key part in the longer side direction.

23. The key switch according to claim 22, wherein the key part is made of an elastic material.

24. The key switch according to claim 16, wherein the second rib is positioned face-to-face with a center of the side wall of the key part in the longer side direction.

25. The key switch according to claim 16, wherein the key part is made of an elastic material.

* * * * *